US006168151B1

(12) United States Patent
Tsuchida

(10) Patent No.: US 6,168,151 B1
(45) Date of Patent: Jan. 2, 2001

(54) CARD TYPE DISPENSER ASSEMBLY WITH BOTTOM LOADING

(75) Inventor: Tamotsu Tsuchida, Iwatsuki (JP)

(73) Assignee: Asahi Seiko Co., Ltd., Tokyo (JP)

( * ) Notice: Under 35 U.S.C. 154(b), the term of this patent shall be extended for 0 days.

(21) Appl. No.: 09/167,858

(22) Filed: Oct. 7, 1998

(30) Foreign Application Priority Data

Oct. 8, 1997 (JP) ..... 9-310985
Oct. 9, 1997 (JP) ..... 9-314178

(51) Int. Cl.[7] ..... B65H 01/08

(52) U.S. Cl. ..... 271/126; 271/148; 271/152; 271/156; 271/157; 414/796.7; 414/797.3; 221/231

(58) Field of Search ..... 271/10.03, 110, 271/113, 126, 148, 152, 153, 154, 155, 156, 157; 414/796.7, 796.8, 797.3; 221/227, 226, 231

(56) References Cited

U.S. PATENT DOCUMENTS 415,877 * 11/1889 Ross .
2,076,186 * 4/1937 Reynolds et al. ..... 271/62
3,580,567 * 5/1971 Hashimoto ..... 271/62
4,077,620 * 3/1978 Frank et al. ..... 271/10
4,268,027 * 5/1981 Oleksiak et al. ..... 271/153
4,269,403 * 5/1981 Stephens et al. ..... 271/3
4,302,000 * 11/1981 Frank ..... 271/150
4,592,485 * 6/1986 Anderson et al. ..... 221/150
4,993,587 2/1991 Abe .
5,104,111 * 4/1992 Matsuda et al. ..... 271/110
5,116,037 5/1992 Gerlier et al. .
5,335,901 * 8/1994 Nonumura et al. ..... 271/117
5,476,254 * 12/1995 Golicz ..... 271/10.05
5,584,476 * 12/1996 Marzullo et al. ..... 271/126
5,620,175 * 4/1997 Hesoun ..... 271/34
5,785,311 * 7/1998 Doery ..... 271/110

FOREIGN PATENT DOCUMENTS 2729487 7/1996 (FR) .
59-64437 4/1984 (JP) .
597258 4/1995 (JP) .
8020452 1/1996 (JP) .

* cited by examiner

*Primary Examiner*—Donald P. Walsh
*Assistant Examiner*—David A. Jones
(74) *Attorney, Agent, or Firm*—Price and Gess

(57) ABSTRACT

A card-like article is provided with an elevator assembly that can elevate a stacked array of cards to a discharge station. The elevator assembly can be incrementally advanced by reciprocating operating rods that extends between pairs of rails. The elevator assembly can be releaseably affixed to the rails by a braking assembly.

19 Claims, 6 Drawing Sheets

CARD TYPE DISPENSER ASSEMBLY WITH BOTTOM LOADING

BACKGROUND OF THE INVENTION

1. Field of the Invention

The present invention is directed to the discharging of relatively thick flat rectangular structures such as floppy disks and packaged IC cards from a dispenser unit that can be easily recharged by an operator.

2. Description of Related Art

Vending machines that have been capable of dispensing card bodies are known in the prior art. For example, Asahi Seiko USA, Inc. has disclosed various configurations of card dispensers that prevent the dispensing of two cards continuously or two cards stuck together, such as in a Model CD-200 wherein a reverse roller can prevent the discharge of two cards that have adhered together.

An example of a discharge apparatus for cards is disclosed in Japanese Utility Patent No. 63-60,147 and U.S. Pat. No. 4,993,587. This disclosure teaches the dispensing of cards using a rubber roller in order to discharge relatively thin cards, such as telephone debit cards. The conventional discharge apparatus are mainly directed for discharging thin cards by gravity feeding of the thin cards to a discharge or ejector mechanism. Such structures are not readily applicable to discharging a relatively thick IC card, floppy disk, or plate-shaped box objects. Conventional apparatus which use a rotating rubber roller for contacting and extending across the surface of the card has its limitations, in that some structures can be damaged by such a discharge or ejection mechanism. Other examples of apparatus for dispensing sheet-type objects can be seen in U.S. Pat. No. 5,116,037. Of interest the Japanese Laid-Open Patent Application No. 59-64,437.

Problems have occurred in the prior art in utilizing a dispensing or discharged position at the bottom of a stack of cards, since in a gravity feed arrangement the weight presented by the lower most card in the stack can be large when there are a large number of articles or cards stacked in the vending machine. This weight can lessen as the inventory of articles are discharged and therefore the conditions of the components of the dispensing structure must deal with a variable weight. Additionally, the components utilized to provide a dispensing structure can take up storage room in the vending machine.

The prior art is still seeking to provide a dispensing apparatus that can handle thick IC cards and the like that can be efficiently dispensed without being subject to a variable weight on the dispensing rollers.

SUMMARY OF THE INVENTION

The present invention provides an improved dispensing apparatus module for dispensing articles in a stacked array in a vending machine. The dispensing apparatus is relatively narrow and efficiently uses the available space in the vending machine. The dispensing apparatus includes an elevator assembly that can movingly support a stacked array of articles so that the articles are lifted upward to a discharging station. The elevator apparatus has a housing with a flat surface for supporting the stacked articles. An elongated rod or rod members can be driven by a camming mechanism connected to a motor to incrementally extend vertically upward and then downward with the elevator mechanism having a clutching/breaking arrangement so that it is incrementally moved upward by approximately the height of a card member. An operator can actuate one or more levers to disengage the clutching/breaking assembly and permit the elevator assembly to be released from support rails and manually position at its lowest position for receiving a new charge of stacked articles.

At the top portion of the dispensing apparatus module an operating lever and sensor can detect an upper movement of an article to be dispensed. The sensor can activate another motor to drive a roller member having a one-sided protrusion so that the upper-most article on the stack of articles is contacted by the protrusion and translated off of the stack. It is possible to complement this arrangement with a second roller assembly that includes a counter-rotation roller to prevent the discharging of more than one article. A detector member can rotate a weighted lever for contacting a sensor to indicate the discharge of the article.

A controller system can coordinate the vending machine receipt of a payment and the activation of the various motors in accordance with sensor outputs.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved discharge module for dispensing card-type articles that can be stacked in the dispensing apparatus and discharged from an upper discharge station with a unique elevator arrangement.

Figure 1:
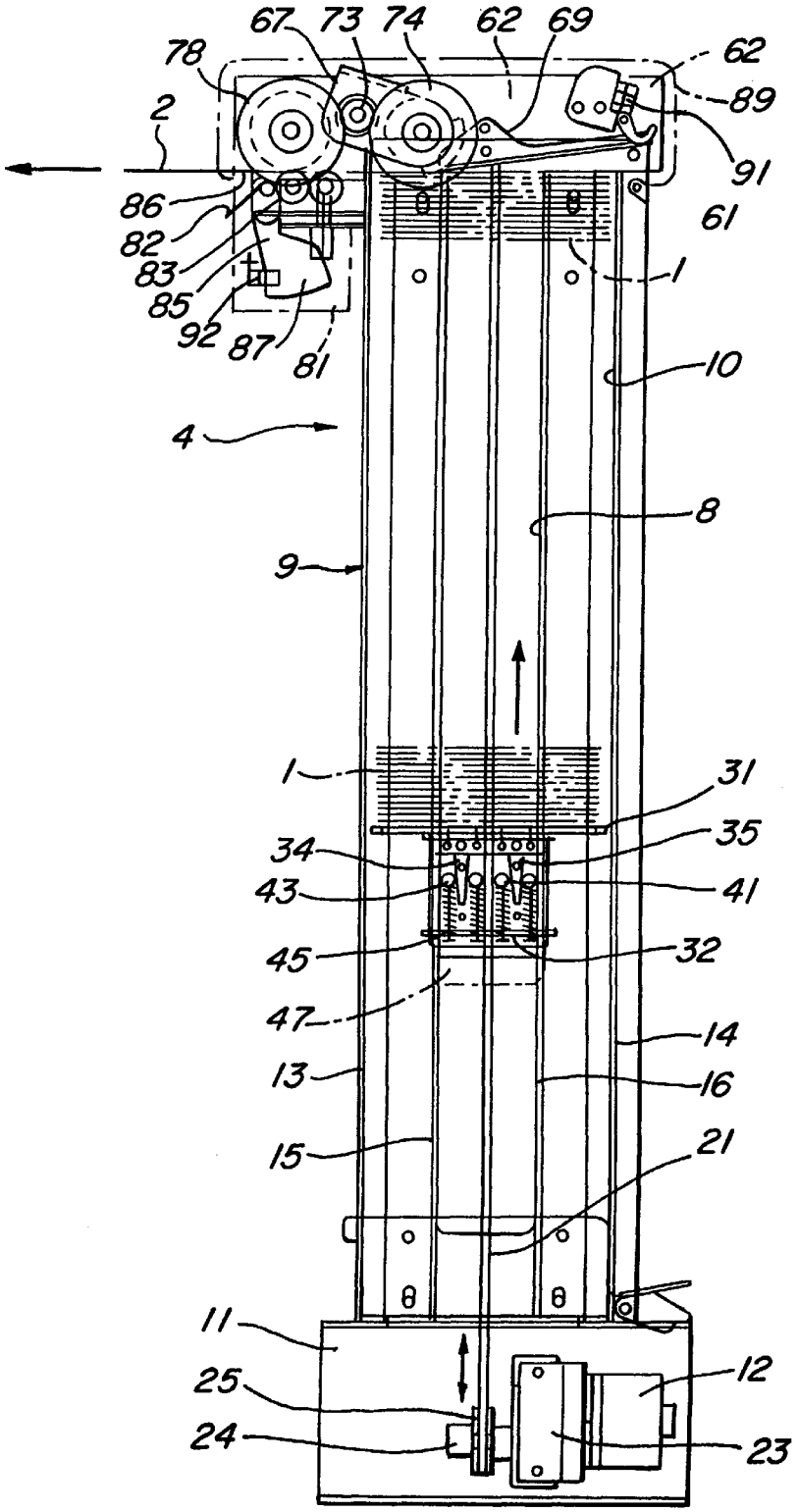
FIG. 1 is an elevated partial cross sectional view showing one example of the invention.
Figure 2:
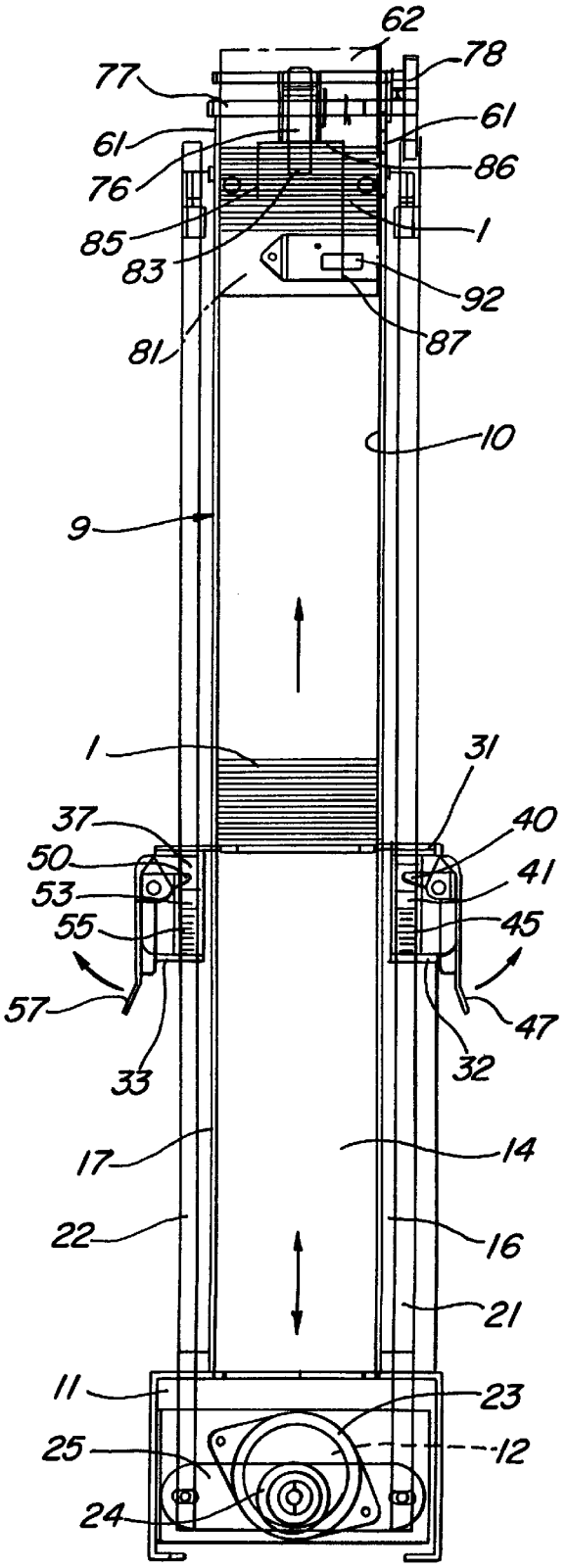
FIG. 2 is an elevated cross sectional end view of the embodiment of FIG. 1.
Figure 4:
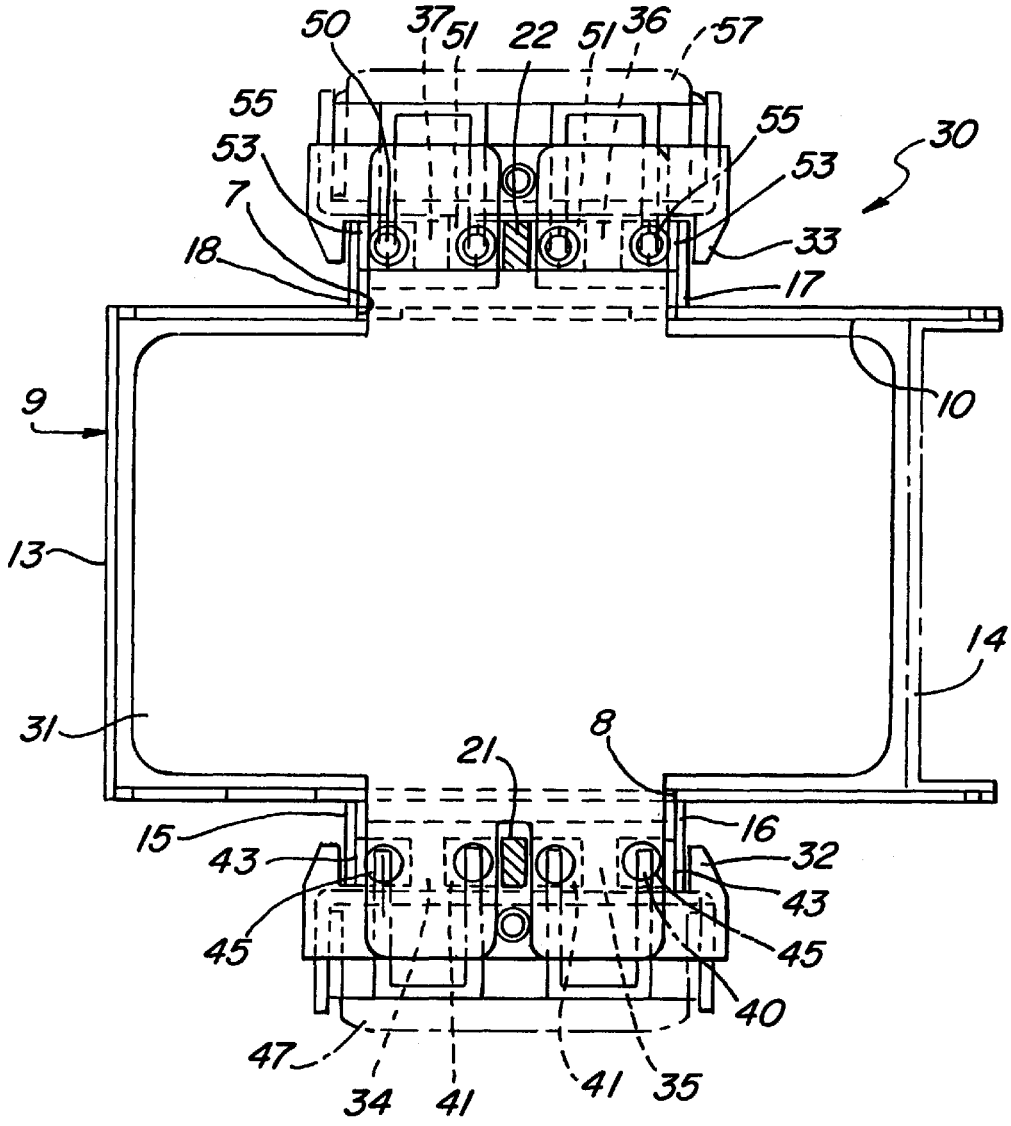
FIG. 4 is an upper planned view partially in cross section disclosing the support surface of the elevator assembly.

Referring to FIGS. 1, 2, and 4 the dispensing apparatus module 4 of the present invention is disclosed in a configuration that is not much wider than the articles or objects to be dispensed, such as the cards 1 disclosed. The dispensing apparatus module 4 can be mounted in a vending machine, not shown, as known by those skilled in the field. An elevator apparatus 30 is provided with a drive system that can lift the elevator apparatus by the cyclic movement of elongated rod members. Appropriate sensors can determine when to drive motors for lifting the elevator apparatus and for rotating rollers to discharge an uppermost article on a stack of articles.

The articles to be dispensed can be an integrated circuit IC cards with instructions, floppy disk magnetic cards, flat rectangular objects and the like.

The base 11 of the dispensing apparatus module 4 has a rectangular configuration and houses an electric motor 12. The base 11 supports, on its upper surface, an elongated housing frame 9 of a cross-sectional general U-shaped configuration. The elongated frame 9 includes a front side panel 13 and also a back side panel 14 that can be opened and closed to expose an aperture along the back side. This aperture permits an operator to recharge the dispensing apparatus module 4 with articles to be dispensed. The sides of the frame 9 include elongated slender holes 7 and 8. As will be described portions of an elevator apparatus 30 can extend through these holes. Mounted vertically along the sides of the frame 9 are pairs of long rails 15, 16 and 17, 18. In the interior of the frame 9 is a storage area, or an accommodation chamber 10 to hold a stack of articles, such as cards 1. The frame housing 9, in essence, constitutes the front and back panels 13, 14 and the two pairs of rails 15–18 that are respectively spaced to provide the intermediate slender elongated holes 7 and 8.

In between the rails 15 and 16 is an elongated operating rod 21 that is shaped as a long thin board and which can be cyclically movable to extend in an upper and downward vertical direction along substantially the height of the housing frame 9. A long thin board or rod 22 is also mounted between the rail sections 17 and 18. The respective rods 21, 22 as shown in FIG. 2 are mounted to an elliptical lever or board 25 which is attached to a cam 24 so that it can be rotated freely. The cam 24 has a concentric configuration and is connected to a revolving output shaft of a gear apparatus 23 that is connected to electric motor 12. The lower ends of the operating rods 21, 22 are respectively pivoted in a loose fitting connection at each end of the ellipse board 25. Rotation of the cam 24 provides a cyclic upward and downward movement of the operating rods 21, 22.

Figure 3:
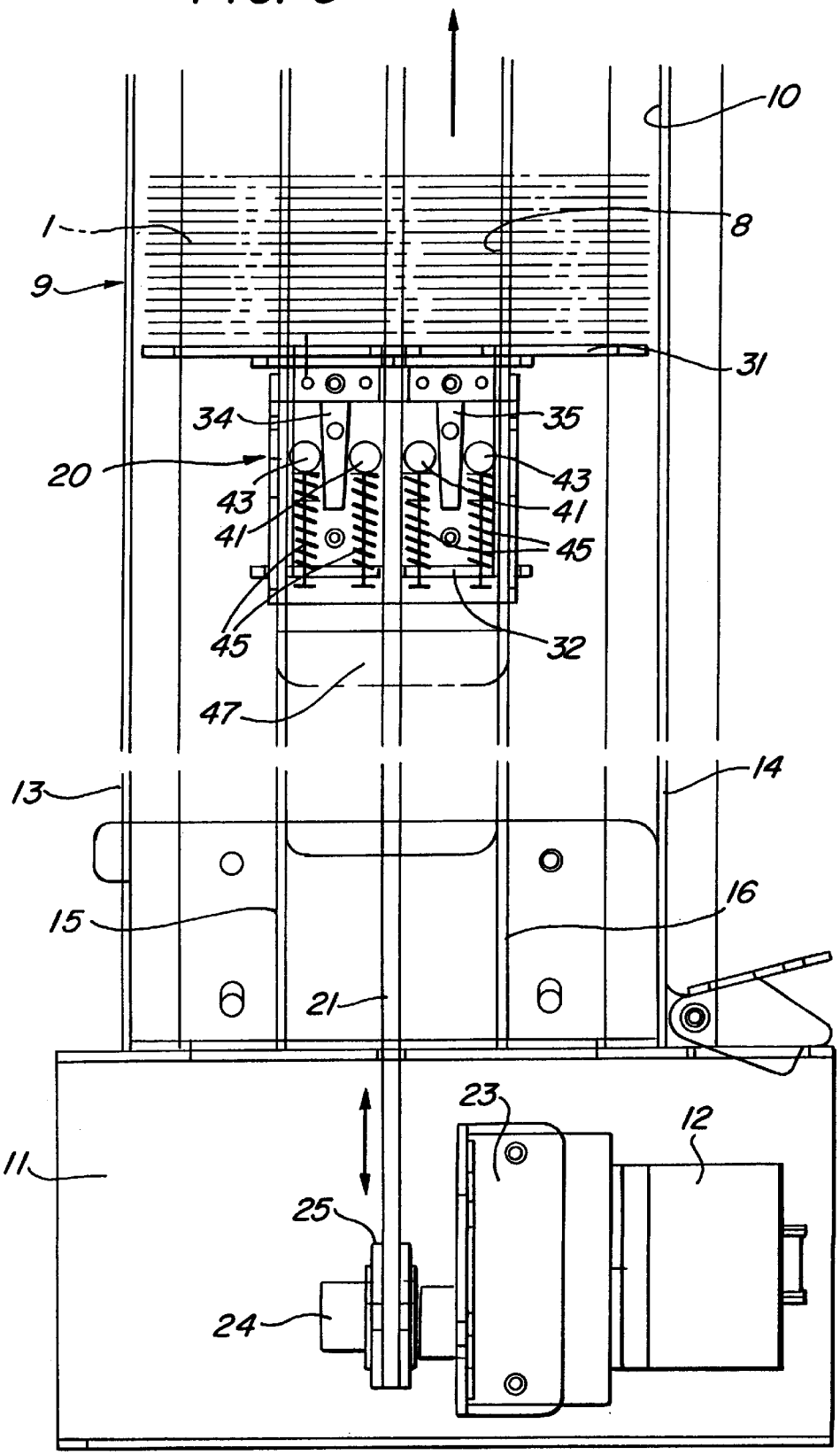
FIG. 3 is a partial cross sectional view of a lower portion of the dispensing apparatus in FIG. 1.

Referring to FIG. 4, the elevator apparatus 30 is shown with an upper horizontal mount stand 31 that is capable of supporting a stack of card-like articles 1. This mount stand 31 can be driven through the storage chamber 10 while being maintained in a stable horizontal relationship. A thinner section on each side of the mount stand 31 projects outwardly from the housing frame 9 through the elongated apertures or holes 7, 8. Attached to each of these outwardly projecting portions of the mount stand 31 are square casing members 32, 33 which further journal or lock the elevator housing to the housing frame 9. In each of the casings 32, 33 are a braking assembly 20 for releaseably connecting the elevator apparatus 30 to the rail members 15, 16 including sets of wedge shaped tapered bodies 34, 35 and 36, 37. Also extending through the respective case housings 32, 33 are the respective rails, for example rails 15, 16 and the operating rod 21. The tapered bodies 34, 35 are respectively arranged between the operating rod 21 and the right and left rails 15, 16. Rollers 41 are used to move upward the mount stand 31. The rollers 41 are inserted in a vertically movable manner between the operating rod 21 and each of the respective tapered bodies 34, 35. Additionally, rollers 43 are utilized for lowering or returning the mount stand 31 and for stopping and holding the mount stand 31 as a clutching or breaking arrangement when they are arranged between the outside of the tapered body and a respective rail. The rollers are displaceable in the vertical direction although a spring arrangement 45 as shown in FIG. 3 which is utilized to bias each of the rollers upward for contact with the tapered bodies. As a result of this arrangement, roller 41 is pinched between the operating rod 21 and the tapered bodies 34, 35 by means of the spring 45. When the operating rod 21 is moved upward, the rollers 41 are fixed and move the mount stand 31, by contact with the lower extending tapered bodies 34, 35, upward by the same amount of movement as the operating rod 21.

The outside rollers 43 are also pinched between the rails 15, 16 and the tapered bodies 34, 35 by means of the spring arrangement 45. When the operating rod 21 is moved to descend downward, the rollers 43 are appropriately locked to affix the mount stand to the rails and to therefore hold the mount stand at the upward extent of the vertical movement. As a result of this arrangement, the mount stand 31 can be incrementally elevated upon an appropriate activation of the electric motor 12 so that during the cyclic movement of the rod 21 the stand is advanced and then when the rod is retracted it is locked as a result of the engagement of the rollers 43 and the rails 15, 16. Additionally, when the operating rod 21 is moved downward, the locking situation of the rollers 41 are released. Conversely, however when the operating rod 21 is moved upward, the locking situation of the rollers 43 are released as the outside slanting surface of the tapered bodies 34 rotate the rollers 43 counterclockwise and release them from the wedging or locking action between the rail and the respective tapered body. The same arrangement occurs on the other side of the mount stand 31 for the rollers 51 which are capable of elevating the mount stand 31 when they are positioned between the operating rod 21 and each of the tapered bodies 36, 37. Additionally, the rollers 53 are capable of locking the mount stand 31 between the respective tapered bodies 36, 37 and the right and left rails 17, 18. Again, a spring arrangement 55 is used for vertically biasing the rollers 51, 53.

In order to seal the aperture of each of the case housings 32, 33 a pair of pivotally mounted lever boards 47, 57 as shown in FIG. 2 are respectively provided. It should be noted that the upper portion of these lever boards 47, 57 are pivotally mounted and an inwardly traverse positioned arms 40, 50 are provided. These levers 47, 57 can be manually rotated as shown by the arrows in FIG. 2 to cause the arms 40, 50 to compress the spring arrangement 45 and to release the locking rollers and permit the elevator with its mount stand to be lowered to accommodate a recharging of the storage chamber 10 with card-like articles.

Figure 5:
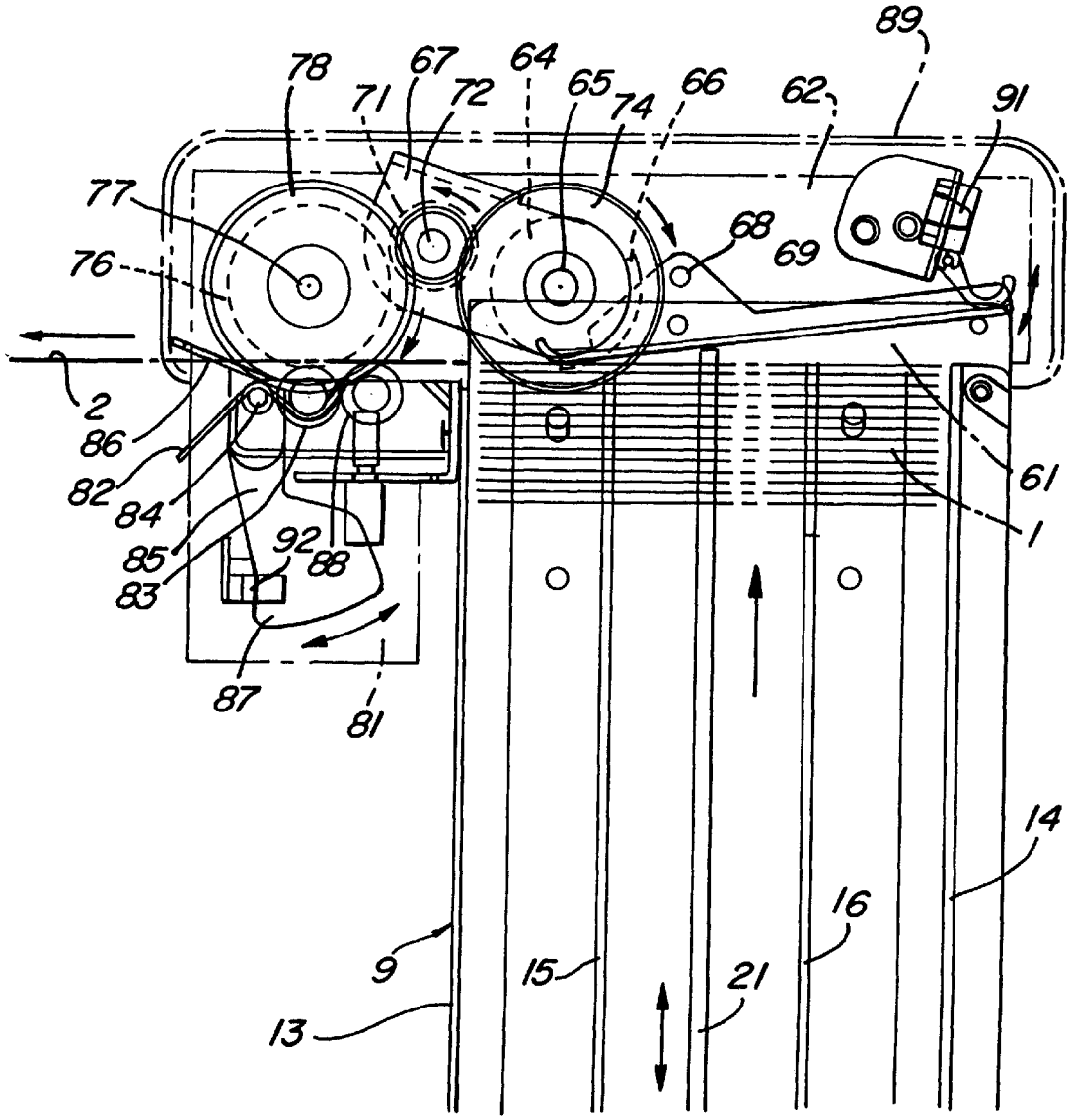
FIG. 5 is a cross sectional view of the upper discharge station of the embodiment of FIG. 1.
Figure 6:
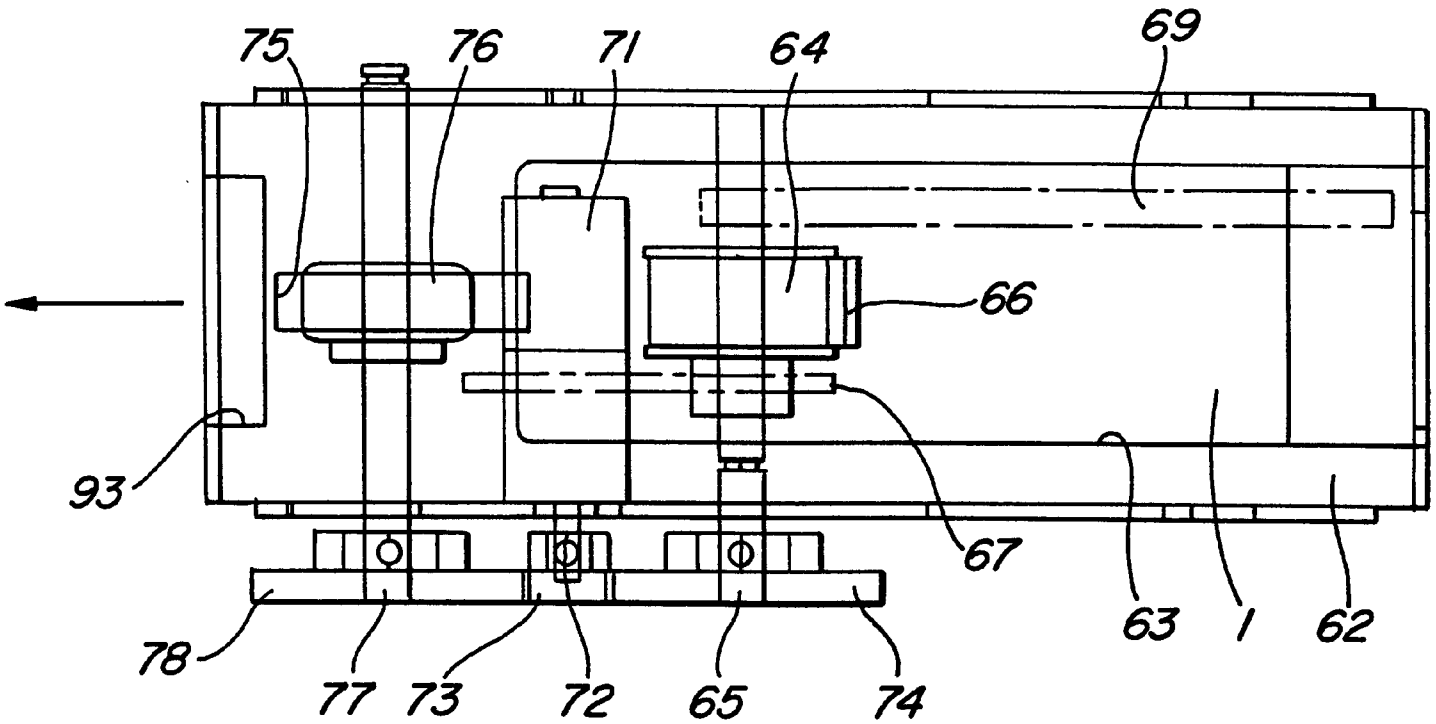
FIG. 6 is a schematic planned view of the discharge station of FIG. 5.

The discharge station for dispensing apparatus module 4 is provided at the upper portion of the frame 9, as shown in FIGS. 1 and 2. This discharged station or apparatus can be attached between a pair of apical-like plate parts 61. These apical plate-like parts 61 can be formed by appropriately constructing the top portions of the frame 9. The discharging apparatus is equipped with a square ring-type case or housing 62 with a bottom as shown in FIG. 6. The discharge apparatus or housing can be fixed between the pair of apical-like plate parts 61 via the case 62. A large rectangular opening 63 is formed on the backside of the bottom of the case member 62. The opening 63 is sufficient to receive the card-like articles as they are moved upward by the elevator apparatus 30. In order to discharge the top card 1, which is positioned almost in the center of the case 62, a driven roller arrangement is provided, which includes a roller 64 having a protrusion 66 mounted on a shaft 65. The shaft is driven through a transmission gear arrangement constituting a driven pinion gear 73 that is connected to the output shaft of an electric motor 71. A protrusion 66 made from rubber extends from the peripheral portion of the delivery roller 64, so that a card that projects from the opening 63 can be contacted by the rotation of the protrusion 64 and discharged. A small rectangular housing part 67, as shown in FIG. 5, is provided on the shaft 65, so that it can rotate freely and it is also provided about the electric motor 71 that is fixed in a casing 62. The rectangular housing part 67 can press the roller 64 onto the card via a coil spring, not shown. As a result of this arrangement, the shaft 65 of the delivery roller 64 is arranged via a hole which can be elongated and not shown in the casing to permit the shaft 65 to be movably displaced in a vertical direction with a bias of the coil spring. As shown in FIG. 6, it is preferable that the housing of the rectangular part 67 be arranged on both sides of the delivery roller 64 to equalize the counteracting forces. It is also possible to provide a weight for it to make the delivery roller 64 of a substantial weight so that the card can be pressed by the delivery roller without a spring arrangement. Thus, as described, the delivery roller 64 is mounted on the housing part 67, so that it is pivoted to accommodate the contact with the uppermost card 1 on the stacked array.

Referring to FIG. 5, a shaft 68 extends across both sides of the case housing 62 and supports an operating lever or rod 69 that is also arranged on both sides of the delivery roller 64. This operating rod 69 is designed to contact the upper surface of a card when it is being elevated into a discharge position. Referring to FIG. 6, a small, long and slender hole 75 is formed in the bottom and the front part of the bottom of casing 62. On both sides of the upper casing 62 a roller 76 can also be used to cooperate with the delivery roller 74 for discharging a card such as figuratively shown in FIG. 5, as a discharge card 2.

Suspended from the left-hand side of the casing 62 is a small rectangular U-type frame 81 that is attached underneath the case 62. A small support roller 83 is mounted to press on the undersurface roller 76 as a result of a bias of a coil spring 82 that is arranged in a vertically movable manner in the small frame 81. Pivotally mounted within the frame 81 is a roughly rudder shaped or L-shaped operating body 85. When a card is discharged by the roller 76 and 83, the card will contact a lever or inclination member 86 which is mounted to extend into the path of the discharge card. The lever 86 is intrinsically connected to the operating body 85, so that the operating body 85 is rotated within the housing 81 when a card depresses the lever 86. The operating body includes a lower weighted portion 87 which during a stationary state rests against a sensor 92. When the weighted portion 87 is separated from the sensor 92, the signal is provided indicating the discharge of a card. Once the card is released from the lever 86, the operating body 85 rotates to return to its original position as a result of the weighted part 87 and the weighted part 87 contacts the sensor 92. As a result of this detection of the weighted part 87 again contacting the sensor 92, the electric motor 71 is stopped and the pinion gear 73 and the respective gears 74, 78 also stop.

The movement of the card between the roller 76 and the idler roller 83 causes the idler roller to move in a counterclockwise direction, which in turn forces roller 88 to rotate in a clockwise and reverse direction. As this inversion roller 88 contacts the underside of the card 2, this rotation helps prevent any discharge and duplication of the card, that is two cards would not be released because of the braking effect of the counter rotation of roller 88. A housing or cover 89 with an appropriate slot to receive the discharge card is mounted over the discharge apparatus and also protects the lever 86 from an external contact. The lever piece 86 which extends from the operating body 85 moves freely within a notch 93 as seen in the plan view of FIG. 6.

As noted above, the dispensing apparatus module can be stocked with a stack of cards when the elevator apparatus 30 is manually released by an operator lifting the respective levers 57, 47 as shown in FIG. 2. The arms 40, 50 press the respective rollers 41, 43, 51, 53 against the respective springs 45, 50. Thus the locking action of the rollers are released as long as the springs are depressed and the mount stand 31 can then be moved upward or downward as desired by the operator. With the mount stand at its lowest position and the inventory of cards stacked above the mount stand a controller (not shown) can receive a signal indicating that a card is to be dispensed. For example, the depositing of money in the proper amount may activate a signal to the controller to activate the electric motor 12. When the electric motor 12 is activated, the concentric cam 24 will rotate by a half-cycle so that a pair of operating rods 21, 22 will also be vertically moved by an increment. For example, if the thickness of the card is approximately 1 millimeter, the operating rods 21, 22 can be designed to move 1 millimeter or the length or the height of one card. When the mount stand 31 raises by 1 millimeter as the result of the actions of the clutch/braking roller assemblies 41, 51 a lock situation can occur to hold the mount stand at that position. The electric motor 12 is actuated so that the concentric cam 24 is rotated again by one-half of a cycle whereby the pair of operating rods 21, 22 will be subsequently lowered by 1 millimeter. The action of lowering the operating rods 21, 22 releases the locking action of the four rollers 41, 51. However, the elevator mount stand 31 is maintained by the rollers 43, 53 at its elevated positioned and is not lowered with the movement of the operating rods. In essence, the arrangement of the clutching/braking rollers and tapered member permits the mount stand 31 to be incrementally moved in one millimeter movements up the respective operating rods 21, 22 and held fast to the respective rails. Thus, every time the concentric cam 24 is activated to rotate by one cycle, the mount stand will be raised a distance, for example by about one millimeter corresponding to the thickness of one card. As can be appreciated, the rollers 41, 43, 51 and 53 are formed with a cylinder type, globular, a semi-circle pilaster, hemisphere type, etc. configuration. In addition, the tapered bodies 34–37 are fixed so that they are suspended downward within the case 32, 33. Additionally, the tapered body 34–37 can also be fixed so that they are standing up in the case 32, 33. Basically, it is the inclination of the tapered bodies relative to the rollers which provide the locking action so that the rollers are locked between the tapered body and the respective rails. In the embodiment disclosed, the tapered bodies are wide in their upper portion and narrow in their lower portion. As also can be appreciated, the arrangement of providing the spring 45 for biasing the rollers is not limited to the particular illustration.

As an alternative embodiment, it is not necessary that four rails 15–18 and two operating rods 21, 22 be used. If the weight of the card bodies is not particularly heavy, two rails 15, 16 and one operating rod 21 can be used in a simplified configuration. Additionally, it would also even be possible as another embodiment for operating rod 21 to be arranged to act with only one rail.

Depending upon the arrangement of the vending machine, it may be possible to provide an orientation in a horizontal, rather than a vertical direction, with the mount stand 31 orientated in a vertical arrangement to push a stack of card members to a discharge position.

When a card at the top of the stacked array is pushed up, it comes into contact with the lower end of the operating rod 69, see FIG. 1 and 5. The movement of the card I will cause the lower end to be pushed up while the other end of the operating rod 69 will be pushed down as it is pivoted about its shaft 68. The sensor 91 will sense the rotation of the operating rod 69. The sensor 91 will provide a signal to a controller that can deactivate the electric motor 12 so that the further pushing upward of the card 1 will stop, as can be appreciated an arrangement other than an electric motor 12 and the concentric cam can be utilized to cause the incremental movements of the operating rods. Another switch can be also utilized to determine the proper position of the card so that a card discharge signal can be generated and the upper electric motor 71 will be actuated. The pinion gear 73 will drive the gears 74, 78. The gear 74 will rotate the delivery roller 64 so that the top card will come into contact with the protrusion 66 that is made from rubber or other resilient material. The card will be moved horizontally and pinched between the delivery roller 76 and the auxiliary roller 83 so that it is discharged from the vending machine. As the card is discharged, it will contact the lever 86 so that it will be depressed downward. This, in turn, will rotate the operating body 85 so that its lower pivoted weighted portion 87 will separate from the sensor 92. The discharging of the card 2 is therefore confirmed as a result of the signal from the sensor 92. Once the card is discharged, the lever will be released and the operating body 85 will return to its original position as a result of the weighted portion 87. The weighted portion 87 will again contact the sensor 92 to produce a signal which could then be used to stop the electric motor 71. Although the delivery roller 64 is rotated, the subsequent card is not released as a result of the protrusion 66. In addition, the second sensor 92 is not always necessary in deciding the time for starting the movement of the electric motor 71. Also, the card 72 could be discharged directly by the delivery roller 76, thereby omitting the auxiliary roller 86.

In summary, the present invention provides a highly effective arrangement of discharging, from the top of a stack array of cards, the uppermost card in a consistent manner, regardless of the number of cards that are left on the array.

Those skilled in the art will appreciate the various adaptations and modification of the above-described preferred embodiments can be configured without the parting from the scope and the spirit of this invention. Therefore, it is to be understood that, within the scope of the appended claims, the invention may be practiced other than specifically described herein.

What is claimed is:

1. In a dispensing apparatus for dispensing articles in a stack array in a vending machine, the improvement of an elevator apparatus for movingly supporting the stack array of articles, comprising:

a housing member having at least one vertically mounted rail member;

an elevator apparatus movingly mounted in the housing member for supporting a stack array;

a discharge apparatus mounted in the housing member above the elevator apparatus to receive an uppermost article from the stack array;

a motor;

an elongated rod member mounted to vertically reciprocate along the housing member to provide a path of movement for the elevator apparatus and operatively connected to the motor for reciprocation in a cyclic upward and downward movement; and a braking assembly for releasable connecting the elevator apparatus to the rail member when the elongated rod member is driven upward and subsequently downward whereby the elevator assembly is incrementally advanced upward during the upward movement of the elongated rod member to deliver articles to the discharge apparatus.

2. The invention of claim 1 wherein the discharge apparatus further includes a first sensor for detecting an uppermost article on the stack array and a roller member for removing the uppermost article from the stack array.

3. The invention of claim 1 wherein the roller member includes a protrusion on a periphery of the roller member for contacting the article.

4. The invention of claim 2 further including a second sensor for detecting when the article is dispensed from the discharge apparatus.

5. The invention of claim 1 wherein the elevator apparatus includes a mount stand member having case members mounted external of the housing member and a pair of elongated rod members are connected to the motor and respectively extend through the case members.

6. The invention of claim 5 wherein the braking assembly includes a tapered member and a roller positioned adjacent the rail member, the roller can lock between the tapered member and rail member to fasten the elevator apparatus to the rail member.

7. The invention of claim 6 further including a spring assembly for biasing the roller against the tapered member.

8. The invention of claim 7 further including a manually operated lever to release the roller from a lock position to enable an operator to move the mount stand member.

9. The invention of claim 1 wherein a lever member and cam are connected between the elongated rod member and the motor to provide the reciprocating movement.

10. The invention of claim 6 wherein a second rod elongated member is connected to the motor, the pair of elongated rod members reciprocate along the housing member and the braking assembly includes a pair of tapered members, two pairs of rollers, and a spring assembly for biasing the roller into a lock position between the rails and the respective rod members.

11. The invention of claim 1 wherein the discharge apparatus includes a lever positioned in a path of discharge, the lever has an appended weighted member that is pivotally mounted to be biased to a stationary position and a sensor member is mounted at the stationary position for maintaining contact with the sensor member whereby the discharge of an article will move the weighted member away from the sensor member.

12. The invention of claim 11 wherein a pivoted operating rod is mounted in the discharge apparatus, a second sensor is mounted to contact one end of the lever whereby when the uppermost article is moved upward to contact another end of the lever, the second sensor is activated.

13. The invention of claim 1, further including a tapered member connected to the elevator assembly and a first roller member, the first roller member is positioned between the elongated rod member and the tapered member for providing a locking securement of the tapered member, roller member, and elongated rod member during the upward movement of the elongated rod member.

14. The invention of claim 13, further including a second roller member, the second roller member is positioned between the rail member and the tapered member for providing a locking securement of the tapered member, second roller member, and rail member during the downward movement of the elongated rod member.

15. The invention of claim 14, further including a bias unit to respectively bias the first and second roller members into operative contact with the tapered member.

16. In a dispensing apparatus for dispensing articles in a stack array in a machine, the improvement of an elevator apparatus for movingly supporting the stack articles, comprising:

a housing member including a rail member;

an elevator apparatus movingly mounted in the housing member for supporting a stack array including a pair of elongated rod members and a motor operatively connected to reciprocate both rod members along substantially a height of the housing member;

a discharge apparatus mounted in the housing member above the elevator apparatus to receive an uppermost article from the stack array; and a braking assembly for releasable connecting the elevator apparatus to the housing member when the elongated rod member is reciprocated upward and subsequently downward whereby the elevator assembly is incrementally advanced upward to deliver articles to the discharge apparatus and the braking assembly locks the elevator apparatus at an uppermost vertical position during the reciprocated movement wherein the braking assembly includes a tapered member and a roller positioned adjacent the rail member, the roller can lock between the tapered member and rail member to fasten the elevator apparatus to the rail member.

17. In a dispensing apparatus for dispensing articles in a stack array in a vending machine, the improvement of an elevator apparatus for movingly supporting the stack array of articles, comprising:

a housing member having at least one vertically mounted rail member;

an elevator apparatus movingly mounted in the housing member for supporting a stack array;

a discharge apparatus mounted in the housing member above the elevator apparatus to receive an uppermost article from the stack array;

a motor;

an elongated rod member mounted to reciprocate along the housing member to provide a path of movement for the elevator apparatus and operatively connected to the motor for reciprocation; and an assembly for releasable connecting the elevator apparatus to the rail member when the elongated rod member is driven upward and subsequently downward whereby the elevator assembly is incrementally advanced upward to deliver articles to the discharge apparatus, including a tapered member and a roller positioned adjacent the rail member, the roller can lock between the tapered member and rail member to fasten the elevator apparatus to the rail member.

18. The invention of claim 17 further including a spring assembly for biasing the roller against the tapered member.

19. The invention of claim 18 further including a manually operated lever to release the roller from a lock position to enable an operator to manually move the elevator apparatus.

* * * * *